US007992638B2

(12) United States Patent
Benton et al.

(10) Patent No.: US 7,992,638 B2
(45) Date of Patent: Aug. 9, 2011

(54) DOWNHOLE DISCONNECT MECHANISM

(75) Inventors: Jim B. Benton, Huffman, TX (US); Dhandayuthapani Kannan, Missouri City, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 12/354,232

(22) Filed: Jan. 15, 2009

(65) Prior Publication Data

US 2010/0175870 A1 Jul. 15, 2010

(51) Int. Cl.
*E21B 17/06* (2006.01)

(52) U.S. Cl. ..... 166/242.6; 166/242.7; 166/377

(58) Field of Classification Search ..... 166/242.6, 166/242.7, 377, 125
See application file for complete search history.

(56) References Cited

U.S. PATENT DOCUMENTS

| | | | | |
|---|---|---|---|---|
| 3,631,925 | A | 1/1972 | Nutter | |
| 5,207,274 | A * | 5/1993 | Streich et al. | 166/382 |
| 5,947,198 | A | 9/1999 | McKee et al. | |
| 6,923,256 | B2 * | 8/2005 | Parker | 166/242.7 |
| 7,011,153 | B2 | 3/2006 | Erkol | |
| 7,040,406 | B2 * | 5/2006 | Dore et al. | 166/338 |
| 7,100,696 | B2 * | 9/2006 | Marshall | 166/377 |
| 7,147,052 | B2 | 12/2006 | Erkol | |
| 7,243,728 | B2 * | 7/2007 | Stoesz et al. | 166/318 |
| 7,353,871 | B2 | 4/2008 | Hromas et al. | |
| 2006/0048940 | A1 | 3/2006 | Hromas et al. | |
| 2007/0151722 | A1 * | 7/2007 | Lehr et al. | 166/123 |
| 2008/0041597 | A1 | 2/2008 | Fisher et al. | |
| 2008/0073086 | A1 | 3/2008 | Cook et al. | |
| 2008/0099210 | A1 * | 5/2008 | Gazewood | 166/377 |
| 2008/0236840 | A1 | 10/2008 | Nguy | |

FOREIGN PATENT DOCUMENTS

| | | |
|---|---|---|
| GB | 2424009 | 9/2006 |
| GB | 2425140 | 10/2006 |
| WO | 200063520 | 10/2000 |
| WO | 2005064112 | 7/2005 |

* cited by examiner

*Primary Examiner* — William P Neuder
(74) *Attorney, Agent, or Firm* — Kevin B. McGoff; Rodney Warfford

(57) ABSTRACT

A release device includes a first sub, a second sub, and a connector separably connecting the first and the second sub, wherein the connector includes a shear member disposed with the first sub and a collar connected between the second sub and the shear member.

19 Claims, 3 Drawing Sheets

DOWNHOLE DISCONNECT MECHANISM

TECHNICAL FIELD

The present application relates in general to wellbore tools and operations and more particularly to a disconnect device.

BACKGROUND

Downhole tools for use in a variety of wellbore applications are often disposed in the wellbore on a tubing string. The tubing may be connected to the tool by a disconnect that permits disconnection of the tool if, for example, the tool becomes stuck in the wellbore. By applying a tensile load or other input, the disconnect releases the tool to permit withdrawal of the tubing.

In some instances, a tool such as a retrievable packer is set in the wellbore for conducting operations such as drill stem testing. At a point in time, a stinger can be run into the wellbore to connect with the retrievable packer, release it, and remove it from the wellbore. In some instances the packer release mechanism is damaged or otherwise inoperable resulting in the stinger disconnecting without releasing the packer from the wellbore. To address this problem, some stingers have been modified to ensure a more robust and secure connection with the retrievable packer. However, this more robust connection can result in the inability to disconnect from the packer or other tool if it remains engaged or stuck in the wellbore.

SUMMARY

An exemplary embodiment of a release device includes a first sub, a second sub, and a connector separably connecting the first and the second sub, wherein the connector includes a shear member disposed with the first sub and a collar connected between the second sub and the shear member.

An exemplary embodiment of a retrievable wellbore packer system, includes a packer assembly adapted for retrievably setting in a wellbore, the packer assembly including a release mechanism for disengaging the packer from the wellbore; a stinger having an upper section, a lower section, and a shear mechanism separably connecting the upper section and the lower section, wherein the shear mechanism parts upon the application of a threshold tension on the upper section; and a latch device disposed with the lower section adapted for connecting with the release mechanism.

An exemplary embodiment of a stinger for retrieving a retrievable tool that is set in a wellbore includes a lower sub having a box end and a latch adapted to connect with a release mechanism of the retrievable tool; an upper sub having top end connectable to a conveyance and a pin end disposed in the box end; and a shear mechanism interconnecting the upper sub and the lower sub, wherein the shear mechanism parts upon the application of a threshold tension on the upper sub.

The foregoing has outlined some of the features and technical advantages of the present application in order that the detailed description that follows may be better understood. Additional features and advantages will be described hereinafter which form the subject of the claims.

BRIEF DESCRIPTION OF THE DRAWINGS

The foregoing and other features and aspects of present embodiments will be best understood with reference to the following detailed description of specific embodiments, when read in conjunction with the accompanying drawings, wherein.

DETAILED DESCRIPTION

Figure 1:
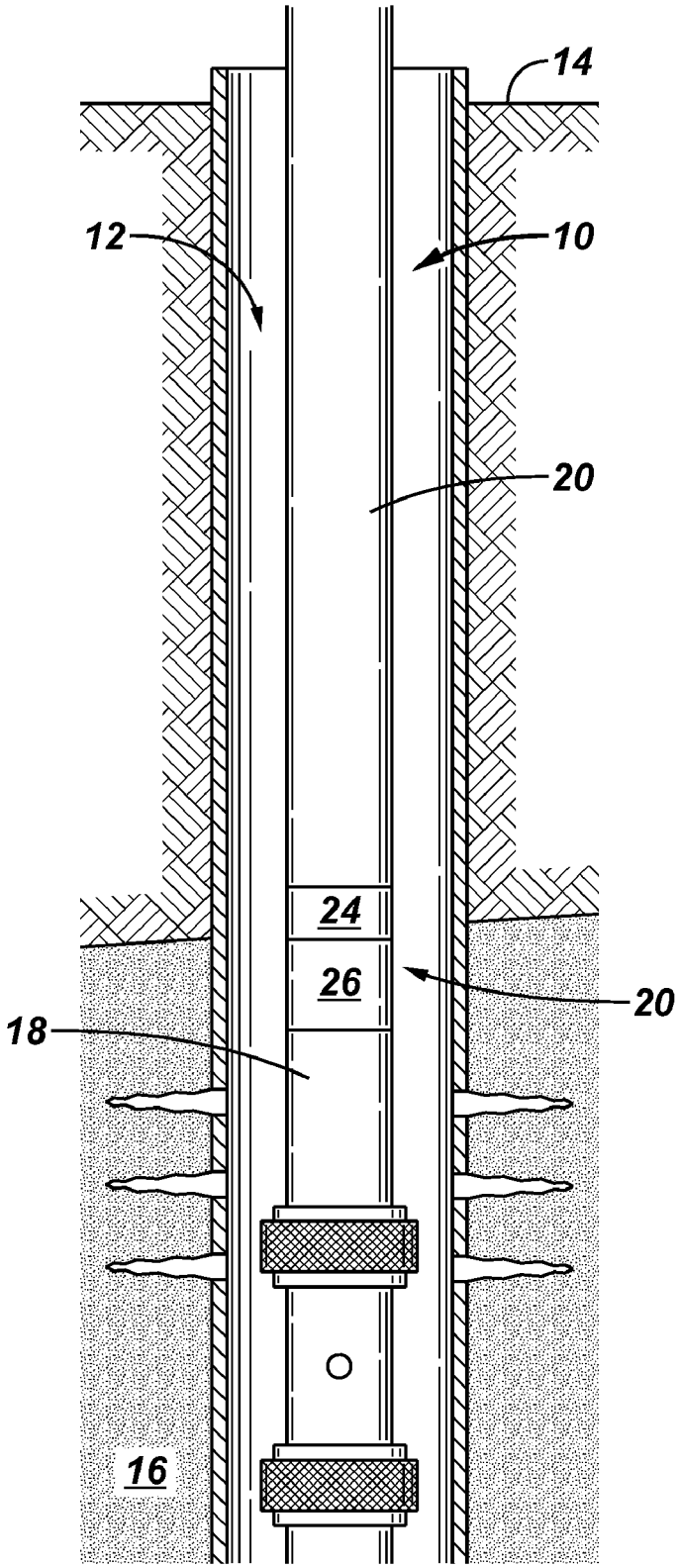
FIG. 1 is an elevation view of an exemplary embodiment of a disconnect system in a wellbore.

Refer now to the drawings wherein depicted elements are not necessarily shown to scale and wherein like or similar elements are designated by the same reference numeral through the several views.

As used herein, the terms "up" and "down"; "upper" and "lower"; and other like terms indicating relative positions to a given point or element are utilized to more clearly describe some elements of the embodiments. Commonly, these terms relate to a reference point as the surface from which drilling operations are initiated as being the top point and the total depth of the well being the lowest point.

FIG. 1 is an elevation view of an exemplary embodiment of a system 10 of the present application disposed in a wellbore 12. Wellbore 12 extends from a surface 14 and penetrates a subterranean formation 16. In the illustrated embodiment, a tool 18 is disposed in wellbore 12 and connected to a conveyance 20. A disconnect 22 is disposed within conveyance 20. If tool 18 cannot be removed from wellbore 12, disconnect 22 separates the upper section, or sub 24 of disconnect 22, from the lower section, or sub 26 of disconnect 22. Application of a tensile load to disconnect 22 separates the upper section 24 from the lower section 26. Disconnect 22 is activated to separate the lower and upper section by application of a tensile load and does not require rotating or applying torque to disconnect 22.

Conveyance 20 may comprise tubing, such as a jointed tubing string or coiled tubing. "Tubing" is utilized herein to include all oilfield tubulars, including tubing, casing, drill-pipe and the like. Tool 18 may comprise a variety of tools, such as packers illustrated herein, valves, and the like. Tool 18 may be a single device or incorporated in a tool string. Disconnect 22 is commonly connected between tool 18 at lower sub 26 and conveyance 20 at upper sub 24. However, disconnect 22 can be connected at other locations above tool 18.

Figure 2:
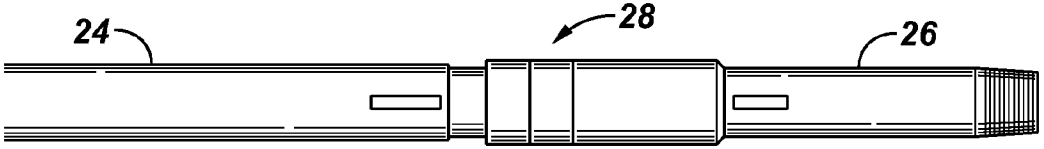
FIG. 2 is an elevation view a disconnect according to an embodiment.

Referring to FIG. 2, an elevated view of an embodiment of disconnect 22 is illustrated. In this embodiment, disconnect 22 is a tubular member having and upper sub 24 and a lower sub 26 releasably connected to one another by shear connector 28. "Upper" and "lower" are used for purposes of description of the illustrated embodiments, therefore, first and second may be used from time to time herein in combination with portions or sections of disconnect 22.

Figure 2A:
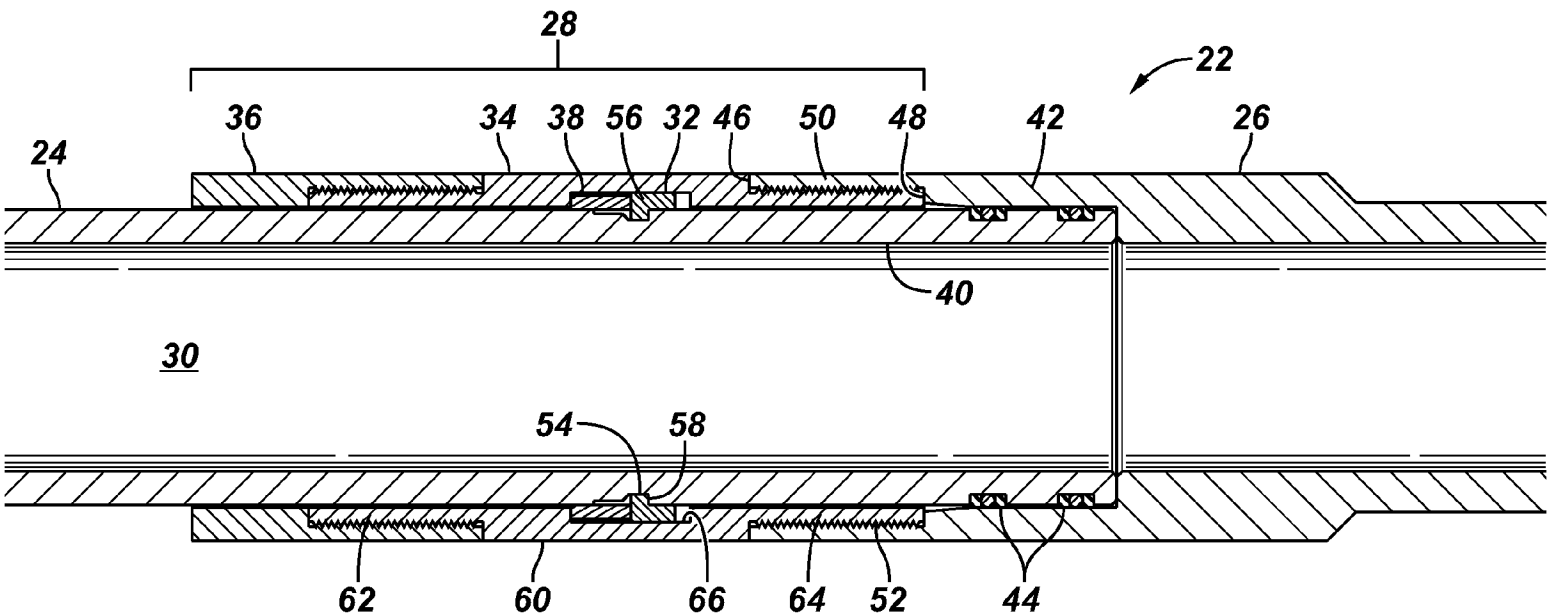
FIG. 2A is a cross-section view of a portion of disconnect according to an embodiment.

Refer now to FIG. 2A, wherein a cross-section view of a portion of disconnect 22 according to an embodiment is illustrated. Disconnect 22 forms a central bore 30 therethrough. Shear connector 28 provides the separable connection between first sub 24 and second sub 26. In the illustrated embodiment, shear connector 28 includes a shear member 32, collar 34 and a cap 36. Shear connector 28 may further include a load ring 38. First sub 24 includes a pin end 40 that can be disposed in a box end 42 of second sub 26. Seal members 44, such as o-rings, may be disposed between pin end 40 and box end 42.

In the illustrated embodiment, box end 42 includes an external shoulder 46 and an internal shoulder 48. External shoulder 46 and internal shoulder 48 are spaced apart by a run 50. Run 50 has an interior surface 52. In some embodiments, interior surface 52 can be threaded.

In one embodiment, shear member 32 is a ring shaped member having an inner portion 54 and an outer portion 56. Inner portion 54 is disposed in a cavity 58 formed on the exterior of first sub 24 proximate to pin end 40 with outer portion 56 protruding radially outward from first sub 24. Shear member 54 may be formed by members other than a ring, or split-ring, such as without limitation screws and pins.

Collar 34, which may be referred to as a split collar, includes a medial section 60 positioned between a pin leg 62 and a box leg 64. A trap 66 is defined on three sides by medial section 60, pin leg 62 and box leg 64.

In one embodiment, shear connector 28 releasably connects first sub 24 and second sub 26, wherein: inner portion 54 of shear member 32 is disposed in cavity 58; upper portion 56 of shear member 32 is disposed in trap 66 of collar 34; box leg 64 of collar 34 is disposed between run 50 and first sub 24; and cap 40 is disposed over pin leg 62 of collar 34 and a portion of first sub 24. In some embodiments, load member 38 may be disposed in trap 66 between a portion of shear member 32 and collar 34.

In the illustrated embodiment, cap 36 can be fixedly connected to pin leg 62 but it is not fixedly connected to first sub 24 and permits first sub 24 to move relative to second sub 26 upon shearing, or parting, of shear member 32. Box leg 64 of collar 34 may include external threads for fixedly connecting to second sub 26 via internal threads provided at surface 52 of run 50.

Figure 3:
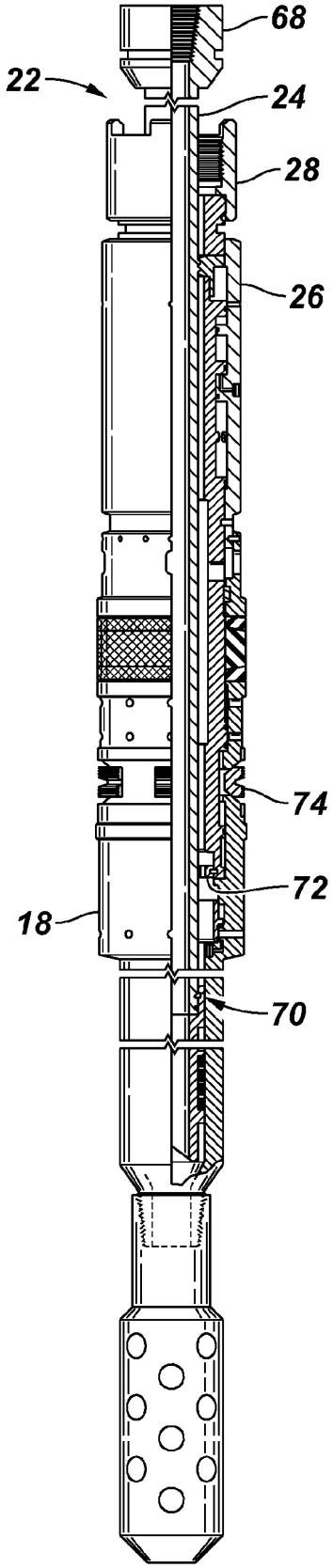
FIG. 3 is a partial cross-section view of a disconnect stinger and a retrievable wellbore tool according to an embodiment.

Refer now to FIG. 3, wherein a partial cross-sectional view of an embodiment of disconnect 22 utilized with a tool 18 is illustrated. In this exemplary embodiment, disconnect 22 is provided as a stinger for connecting with and removing a retrievable packer 18. Stinger 22 includes an upper sub 24 and a lower sub 26 separably connected by a shear connector 28. Upper sub 24 includes a connector 68 for connecting with conveyance 20 (FIG. 1). Lower sub 26 includes a primary latch 70 adapted to connect with a release mechanism 72. In this embodiment, latch 70 is a collet and release mechanism 72 is a ring.

An exemplary embodiment of a method is now described with reference to FIGS. 1 to 3. Packer 18 is set in wellbore 18 and drill stem testing is performed. To retrieve packer 18, a disconnect 22 in the form of a stinger is connected to a tubing string 20 and run into wellbore 12. Stinger 22 is stabbed into the retrievable wellbore tool, illustrated as packer 18. Tension is then applied to stinger 22, engaging latch 70 with release mechanism 72. Continued application of tension on ring 72 via stinger actuates slips 74 to a relaxed position and releases packer 18 from engagement in wellbore 12. The released packer 18 can then be retrieved via tubing 18.

From time to time, packer 18 will be stuck in wellbore 12 for a variety of reasons. In some situations, tool 18 will get stuck while it is being retrieved or the stinger may be fixedly connected to the packer and the packer may not release from the wellbore. When stuck, overpull can be applied to conveyance 18, thereby applying the tension to shear member 32. Tension can be supplied in excess of a threshold tension thereby causing shear member 32 to part, thereby releasing upper sub 24 from connection with lower sub 26 and the connected tool 18.

From the foregoing detailed description of specific embodiments, it should be apparent that a system for disconnecting a first member from a second member in a tubing string that is novel has been disclosed. Although specific embodiments have been disclosed herein in some detail, this has been done solely for the purposes of describing various features and aspects claimed, and is not intended to be limiting with respect to the scope of the claims. It is contemplated that various substitutions, alterations, and/or modifications, including but not limited to those implementation variations which may have been suggested herein, may be made to the disclosed embodiments without departing from the spirit and scope of the appended claims which follow.

What is claimed is:

1. A release device, comprising:

a first sub;

a second sub; and a connector separably connecting the first and the second sub, wherein the connector includes a shear member disposed with the first sub and a collar connected between the second sub and the shear member, wherein the collar comprises a median section defining a trap and a leg member, wherein a portion of the shear member is disposed in the trap and the leg member is fixedly connected to the second sub.

2. The device of claim 1, wherein the shear member is a ring member.

3. The device of claim 2, wherein the shear member comprises an inner portion disposed in the first sub and an outer portion extending radially outward from the first sub.

4. The device of claim 1, wherein the shear member comprises an inner portion disposed in the first sub and an outer portion extending radially outward from the first sub.

5. The device of claim 1, wherein the leg member is threadedly connected with the second sub.

6. The device of claim 1, wherein the shear member is a ring member.

7. The device of claim 1, wherein the shear member comprises an inner portion disposed in the first sub and an outer portion extending radially outward from the first sub.

8. The device of claim 7, wherein the leg member is threadedly connected with the second sub.

9. The device of claim 7, wherein the shear member is a ring member.

10. The device of claim 7, wherein:

the shear member comprises an inner portion disposed in the first sub and an outer portion extending radially outward from the first sub;

the collar comprises a median section defining a trap, a first leg, and a second leg, wherein a portion of the shear member is disposed in the trap and the first leg is fixedly connected to the second sub; and further including a cap disposed about the second leg and the second sub.

11. The device of claim 10, wherein the first leg and the second sub are threadedly connected.

12. A retrievable wellbore packer system, the system comprising:

a packer assembly adapted for retrievably setting in a wellbore, the packer assembly including a release mechanism for disengaging the packer from the wellbore;

a stinger having an upper section, a lower section, and a shear mechanism separably connecting the upper section and the lower section, wherein the shear mechanism parts upon the application of a threshold tension on the upper section; and a latch device disposed with the lower section adapted for connecting with the release mechanism.

13. The system of claim 12, wherein the shear mechanism comprises:

a shear member having an inner portion disposed in the upper section and an outer portion extending radially outward from the upper section; and a collar connected to the shear member and the lower section.

14. The system of claim 13, wherein the outer portion of the shear member is disposed in a trap formed by the collar and the collar is fixedly connected to the lower section.

15. A stinger for retrieving a retrievable tool that is set in a wellbore, the stinger comprising:

a lower sub having a box end and a latch adapted to connect with a release mechanism of the retrievable tool;

an upper sub having top end connectable to a conveyance and a pin end disposed in the box end; and a shear mechanism interconnecting the upper sub and the lower sub, wherein the shear mechanism parts upon the application of a threshold tension on the upper sub.

16. The stinger of claim 15, wherein the shear mechanism comprises:

a shear member having an inner portion disposed in the first sub and an outer portion extending radially outward from the first sub; and a collar connected to the shear member and the second sub.

17. The stinger of claim 16, wherein the shear member is a ring.

18. The stinger of claim 16, wherein the collar comprises a median section forming a trap, a first leg and a second leg; wherein the outer portion of the shear member is disposed in the trap and the first leg is disposed between the pin end and the box end.

19. The stinger of claim 18, wherein the first leg is threadedly connected to the box end of the lower sub.

* * * * *